US006160487A

United States Patent [19]

DeLuca

[11] Patent Number: 6,160,487

[45] Date of Patent: Dec. 12, 2000

[54] SINGLE LOCKOUT MECHANISM FOR A MULTIPLE BATTERY COMPARTMENT THAT IS PARTICULARLY SUITED FOR SMOKE AND CARBON MONOXIDE DETECTOR APPARATUS

[76] Inventor: Joseph G. DeLuca, 1450 Farnham Pt., Apt. 201, Colorado Springs, Colo. 80904

[21] Appl. No.: 09/358,789

[22] Filed: Jul. 22, 1999

[51] Int. Cl.[7] ..... G08B 23/00

[52] U.S. Cl. ..... 340/693.7; 340/693.9; 340/693.11; 340/693.12; 361/615; 361/616; 429/97

[58] Field of Search ..... 340/693.7, 693.5, 340/693.1, 693.9, 693.12, 693.11, 628, 632, 636; 116/280; 361/615, 616; 439/500; 429/97, 99

[56] References Cited

U.S. PATENT DOCUMENTS

| | | | |
|---|---|---|---|
| 3,823,367 | 7/1974 | Kaye et al. | 324/29.5 |
| 3,887,393 | 6/1975 | LaRue, Jr. | 136/173 |
| 4,228,428 | 10/1980 | Niedermeyer | 340/628 |
| 4,471,346 | 9/1984 | Nelson et al. | 340/629 |
| 4,525,703 | 6/1985 | Bellino | 340/628 |
| 4,870,395 | 9/1989 | Belano | 340/693 |
| 4,881,063 | 11/1989 | Fawcett | 340/693 |
| 4,959,640 | 9/1990 | Hall | 340/693 |
| 5,055,830 | 10/1991 | Cousins et al. | 340/693 |
| 5,103,216 | 4/1992 | Sisselman | 340/693 |
| 5,191,855 | 3/1993 | Conforti | 116/280 |
| 5,342,707 | 8/1994 | Brooks | 429/97 |
| 5,444,434 | 8/1995 | Serby | 340/628 |
| 5,574,436 | 11/1996 | Sisselman et al. | 340/663 |
| 5,578,996 | 11/1996 | Watson et al. | 340/628 |
| 5,646,598 | 7/1997 | Nickles et al. | 340/628 |
| 5,820,406 | 10/1998 | Hetherington | 439/500 |
| 6,057,055 | 5/2000 | Kumagawa | 429/97 |

*Primary Examiner*—Jeffery A. Hofsass
*Assistant Examiner*—Phung Nguyen

[57] ABSTRACT

A single battery lockout mechanism for a multiple battery compartment in an electrical unit, preferably a smoke detector or a carbon monoxide detector. The lockout mechanism prevents the battery compartment from being enclosed when fewer than all batteries are present in the compartment. The detector unit is of the bracket mounted type in which the lockout mechanism prevents the detector base from being mounted to a wall or ceiling affixed bracket. The electrical detector includes a detector base adapted to mount to the mounting bracket over a mating region. The detector base has a multiple battery compartment comprised of a plurality of battery receiving regions. A single lockout actuator is movably mounted on the base for movement between obstructing and non-obstructing positions. A spring supported by the detector base biases the lockout actuator towards the obstructing position. When all of the battery receiving regions are filled, the action of the spring is overcome and the lockout actuator is moved to the non-obstructing position. The lockout actuator has a battery sensing portion and a lockout tab. In the obstructing position, the battery sensing portion projects into one of the battery receiving regions and the lockout tab projects into the mating region. This tab prevents the base from mounting to the bracket. In the non-obstructing position, the battery sensing portion is disposed adjacent one of the battery receiving regions and the tab is disposed adjacent the mating region to allow the base to be mounted to the bracket.

20 Claims, 13 Drawing Sheets

SINGLE LOCKOUT MECHANISM FOR A MULTIPLE BATTERY COMPARTMENT THAT IS PARTICULARLY SUITED FOR SMOKE AND CARBON MONOXIDE DETECTOR APPARATUS

FIELD OF THE INVENTION

The present invention generally relates to battery powered devices such as carbon monoxide detectors, smoke detectors and the like, and more particularly to lockout mechanisms for such battery powered devices which are powered by more than one battery.

BACKGROUND OF THE INVENTION

Smoke detectors and carbon monoxide detectors are typically mounted at various strategic locations around a house or building to detect dangerous air quality conditions as a result of such things as a fire or a smoke or carbon monoxide producing event. It is a requirement that these detector units are highly reliable so that the detector can detect conditions invisible to the human senses or problematic conditions when the occupants of the building are asleep. As such, prior detector units typically provide an indication when the battery compartment is not filled with a battery. Indeed, there are UL requirements that acceptable and reliable indications of a missing battery be provided in smoke detectors and carbon monoxide detectors.

There are various attempts in the prior art for providing missing battery indication as demonstrated by various U.S. Patents. One attempt provided by the prior art is to prevent a cover or lid from covering the battery compartment in the detector base as demonstrated by Fawcett, U.S. Pat. No. 4,881,063; Niedermeyer, U.S. Pat. No. 4,228,428; Hetherington, U.S. Pat. No. 5,820,406; Hall, U.S. Pat. No. 4,959,640 and certain embodiments of Cousins et al., U.S. Pat. No. 5,055,830. A more desirable approach is to prevent a detector base from mounting to a mounting bracket that permanently fastens to the wall. This is because there is no possibility of mounting the detector to the bracket on the wall without purposely tampering with the detector. Examples of these attempts are illustrated in Belano, U.S. Pat. No. 4,870,395 and certain embodiments of Cousins et al., U.S. Pat. No. 5,055,830.

Older smoke detectors were often powered by a single 9 volt battery. In these single battery detectors, a single lockout mechanism was provided for the battery. However, more modern detectors such as combination smoke/CO, detectors are now often powered by multiple 1.5 volt batteries because of battery life requirements. In detectors having a multiple battery compartment, multiple lockout mechanisms have been necessary to sense the presence or absence of batteries in each of the multiple individual battery receiving regions in the battery compartment because the absence of one of the batteries would be catastrophic and prevent the detector from being electrically operative. However, providing multiple lockout mechanisms is a significant disadvantage. In particular, providing multiple lockout mechanisms and assembling the same is costly. Utilizing multiple lockout mechanisms also undesirably increases complexity and occupies space.

SUMMARY OF THE INVENTION

It is therefore the main objective of the present invention to eliminate the need for multiple lockout mechanisms for a multiple battery compartment in an electrical unit such as a smoke detector or carbon monoxide detector.

In achieving this objective, it is another objective to provide a single lockout mechanism for a detector unit which is of the bracket mounted type.

In achieving these objectives, it is a further objective to provide a highly reliable battery lockout mechanism for a smoke detector or carbon monoxide detector.

It is another objective of the present invention to accomplish these objectives in an inexpensive manner.

In accordance with these and other objectives, the present invention includes a single battery lockout mechanism for a multiple battery compartment in an electrical unit, preferably a smoke detector or a carbon monoxide detector. The lockout mechanism prevents the battery compartment from being enclosed when fewer than all batteries are present in the compartment. It is an aspect of the present invention that the detector unit is of the bracket mounted type in which the lockout mechanism prevents the detector base from being mounted to a wall or ceiling affixed bracket.

According to an aspect of the present invention, an electrical detector includes a mounting bracket that is secured to a wall of a building and a detector base adapted to mount to the mounting bracket over a mating region. The detector base has a multiple battery compartment comprised of a plurality of battery receiving regions. A single lockout actuator is movably mounted on the base for movement between obstructing and non-obstructing positions. A spring supported by the detector base biases the lockout actuator towards the obstructing position. When all of the battery receiving regions are filled, the action of the spring is overcome and the lockout actuator is moved to the non-obstructing position.

According to an embodiment of the invention, the lockout actuator has a battery sensing portion and a lockout tab. In the obstructing position, the battery sensing portion projects into one of the battery receiving regions and the lockout tab projects into the mating region. This tab prevents the base from mounting to the bracket. In the non-obstructing position, the battery sensing portion is disposed adjacent one of the battery receiving regions and the tab is disposed adjacent the mating region to allow the base to be mounted to the bracket.

Other object and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

Figure 24:
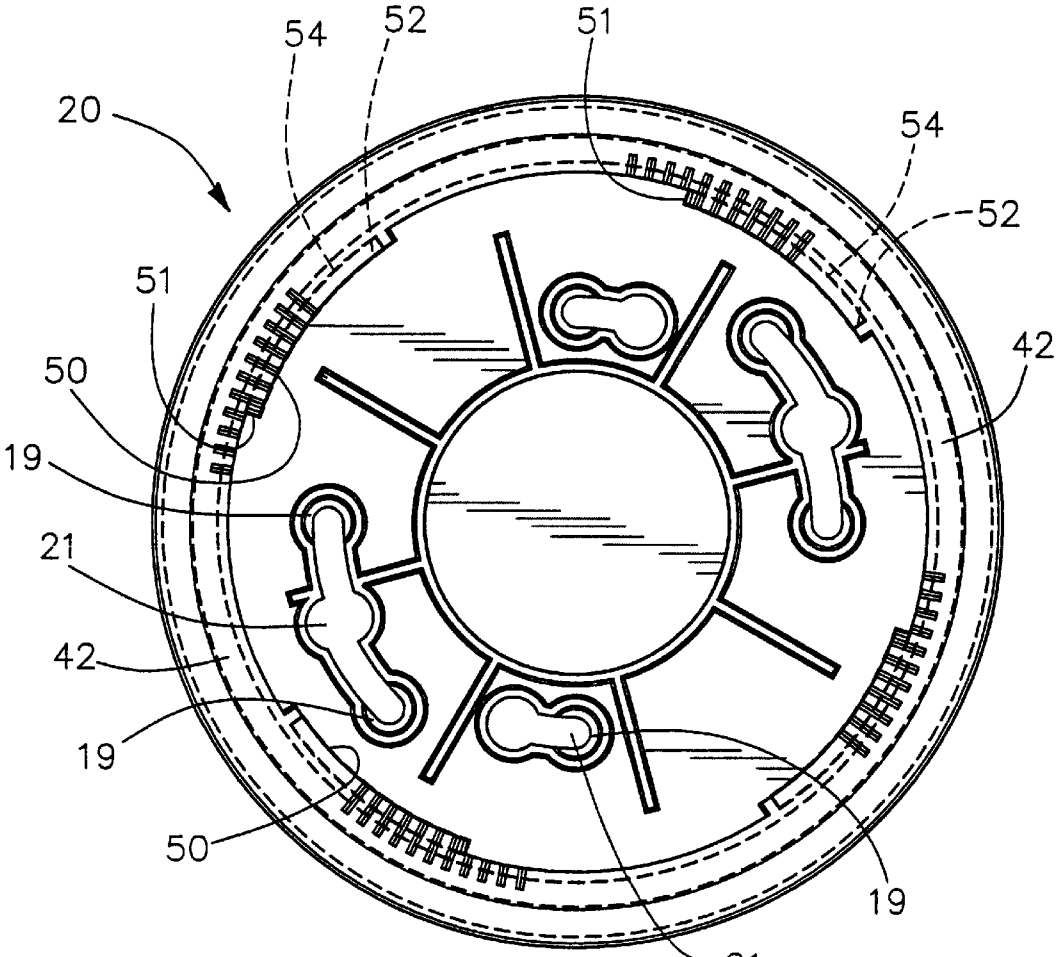
FIG. 24 is a top view of the bracket shown in FIGS. 6 and 7.

For purposes of illustration and referring generally to FIGS. 1–6, a preferred embodiment of the present invention has been illustrated as a smoke/CO detector 10 which is of the bracket mounted type. Except for the battery lockout mechanism 11 and configuration of the battery compartment 22 that will be described in further detail below, the detector 10 is rather conventional in that it includes a detector base 12 which houses various electronic equipment 14, 16 such as a sensor, an alarm, and various signal processing circuitry, a cover 18 for enclosing the electronic equipment 14, 16, and a bracket 20 to which the assembled cover 18 and base 12 mount. As shown in FIG. 24, the bracket 20 includes slots or openings 21 with a seating surface 19 such that the bracket 20 can be fastened to the ceiling or wall of a house or building with screws or other fasteners in a conventional manner. To provide a relatively inexpensive detector, the detector housing components including the base, 12, the cover 18, and the bracket 20 are each separately molded between two dies from conventional plastic materials.

Figure 3:
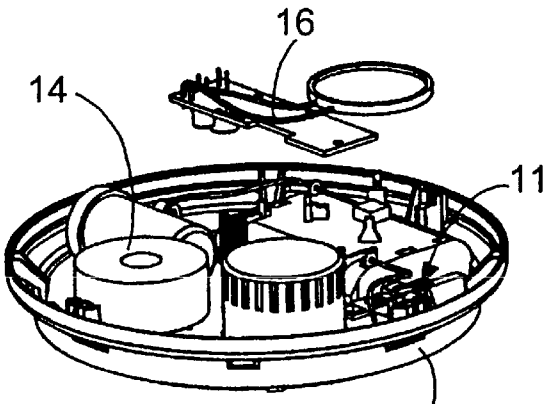
FIGS. 1–7 are perspective assembly views of the various components of a smoke/CO detector according to a preferred embodiment of the present invention.
Figure 2:
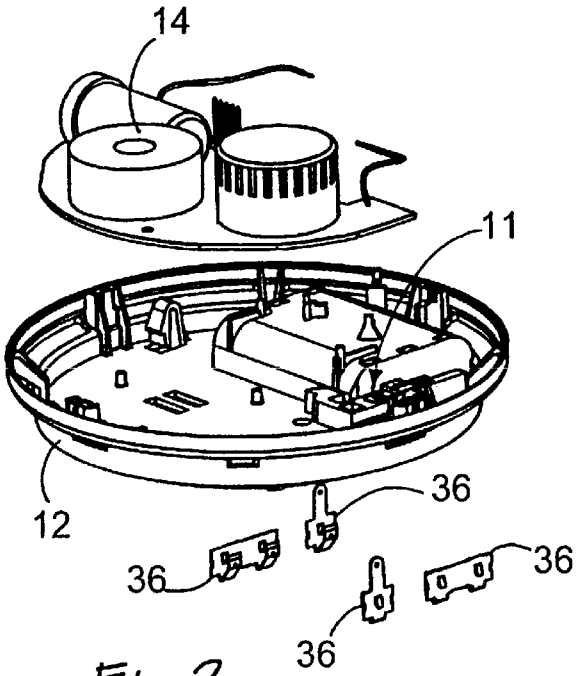
Figure 1:
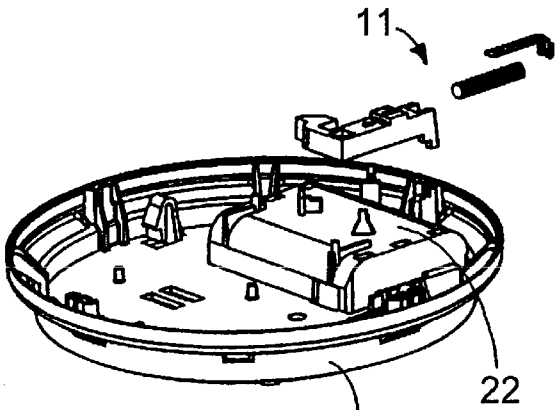
Figure 6:
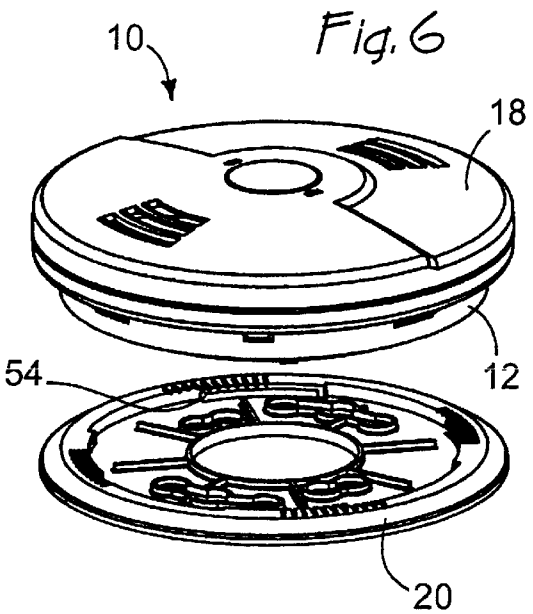
Figure 5:
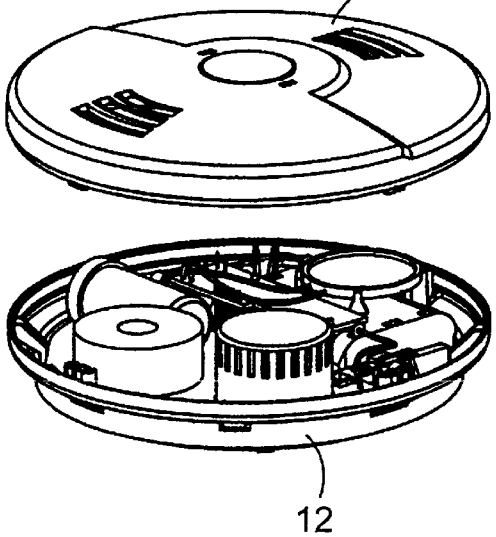
Figure 4:
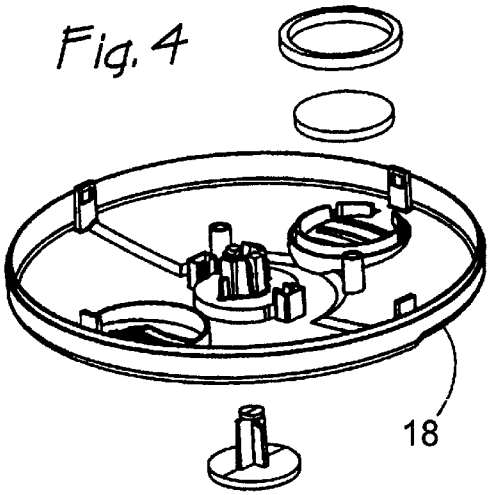
Figure 7:
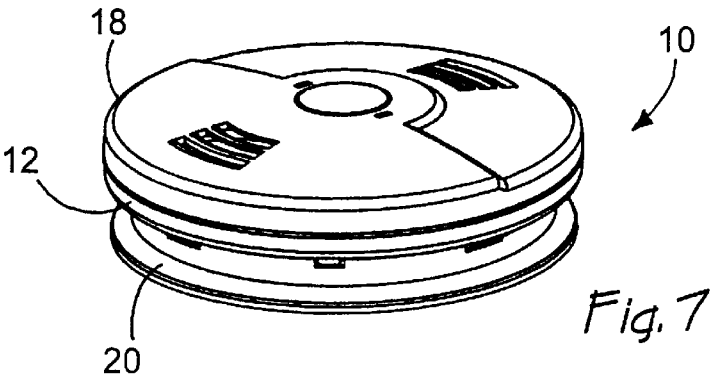
Figure 8:
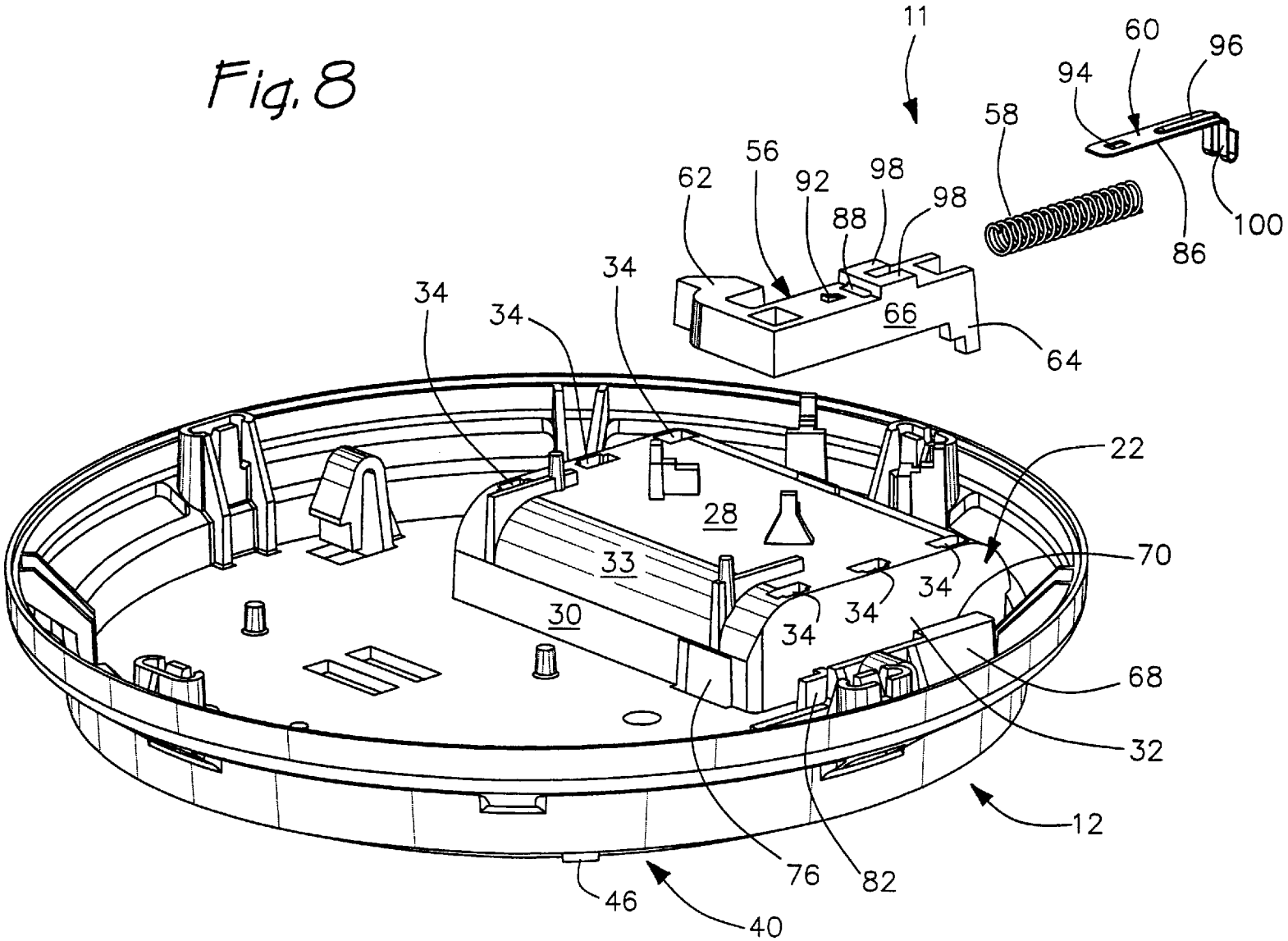
FIG. 8 is a perspective assembly view of the detector base including a battery lockout mechanism according to a preferred embodiment of the present invention.
Figure 9A:
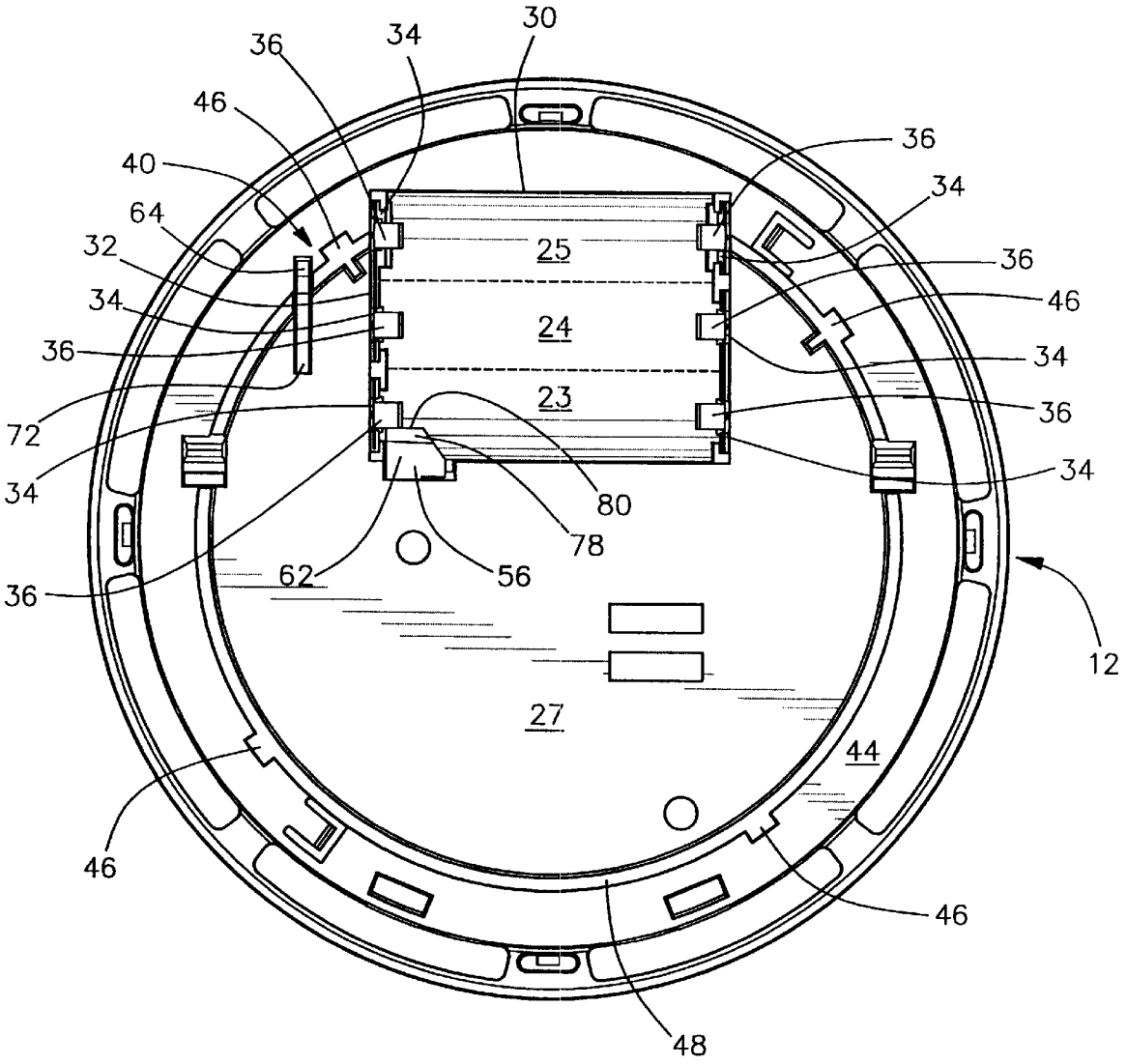
FIG. 9*a* is a top view a detector base including an assembled battery lockout mechanism according to a preferred embodiment of the present invention with the lockout mechanism illustrated in the obstructing position.
Figure 9B:
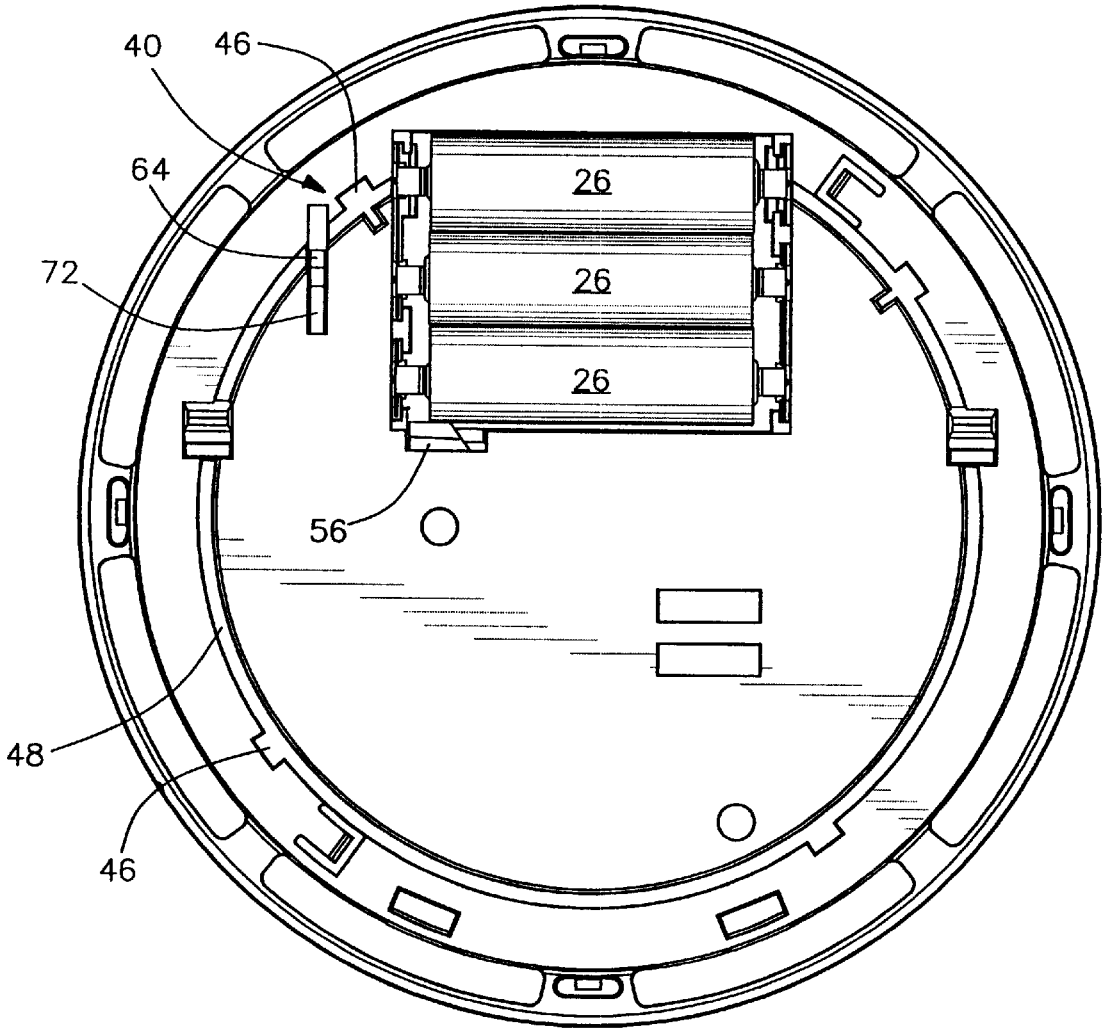
FIG. 9*b* is the same view as FIG. 9*a* but with batteries inserted and the lockout mechanism in the non-obstructing position.

Referring to FIGS. 8, 9*a* and 9*b*, the detector base 12 includes a multiple battery compartment 22 that provides a plurality of battery receiving regions 23–25 for receiving individual batteries 26, which are cylindrical 1.5 volt batteries in the preferred embodiment. The battery compartment 22 is integrally formed into the bracket facing face 27 of the base 12 such that the bracket 20 substantially encloses the compartment 22 when the base 12 is secured to the bracket 20, thereby to retain batteries 26 in the compartment 22. In the preferred embodiment, the battery compartment 22 includes a bottom wall 28, side walls 30 and end walls 32 such that the battery receiving regions 23–25 align in a plane. Each of the walls 28, 30, and 32 are rigid. The side and end walls 30, 32 extend upright and generally perpendicular relative to the bottom wall 28. The side walls 30 merge into the bottom wall 28 along curved walls 33 which are contoured to the cylindrical contour of the batteries 26 which are intended to be inserted in the compartment 22. The side walls 30 extend transversely and generally perpendicular between the end walls 32. Electrically conductive terminals 36 are secured to the end walls 32, two for each battery receiving region 23–25. In the preferred embodiment, the terminals 36 snap into terminal slots 34 molded into the end walls 32. When the batteries 26 are inserted into the compartment 22, the batteries 26 are operatively connected in series to positive and negative end terminals, which are operatively connected to power the electronic components 14, 16 of the detector 10.

Referring to FIGS. 6, 9*a*, 9*b* and 24, the detector base 12 mounts to the mounting bracket 20 over a mating region generally indicated at 40. In the preferred embodiment, the mating region includes a seating surface 42 on the mounting bracket 20 and a corresponding mating surface 44 on the base 12. The mating and seating surfaces 42, 44 are generally radially planar but may also be conical for example. The surfaces 42,44 mate in contact to align retaining members on the base 12 with catch members on the bracket 20, such that when the base 12 is rotated relative to the bracket about a central axis, the retaining members are caught in interlocking engagement with the catch members to retain the base 12 to the bracket 20. A detent mechanism including resilient latch projections on the base 12 and slots on the bracket 20 lock the base and the bracket. In the preferred embodiment the retaining members take the form of tabs 46 that project radially outward from a cylindrical wall 48 rising above the seating surface 42. The catch members comprise an flanges 50 projecting radially inward from the seating surface 42 and along with mechanical stops 52 form slots 54 for receiving the tabs 46. It will also be appreciated by those of skill in the art that other mating regions such as those illustrated in the aforementioned patents which disclose bracket mounted type units may also be used. It will also be appreciated by those of skill in the art in view of these aforementioned patents that the battery lockout mechanism of the present invention may also be incorporated in other types of electrical units in which the means for retaining batteries in the compartment may take the form of a cover for the electrical unit housing, or lid for the battery compartment, or a wall mounted bracket or other battery retainer as appropriate.

In accordance with the present invention, the preferred embodiment includes a single lockout mechanism 11 for the entire battery compartment 22 that can sense when less than all batteries are inserted into the individual receiving regions 23–25, regardless of which region is empty. With reference to FIGS. 8, 9*a* and 9*b*, the lockout mechanism 11 includes a lockout actuator 56 which is preferably molded from rigid plastic material, a resilient spring in the form of a metal coil spring 58, and preferably a relatively rigid but somewhat resilient retainer clip 60, which may be a stamped thin sheet metal component. The lockout actuator 56 includes a battery sensing portion 62, a lockout tab portion 64 and a sliding guide or pilot portion 66. The pilot portion 66 is closely received into a guide channel formed between an end wall 32 of the battery compartment 22 and a guide wall 68 integrally formed with the base 12 in parallel relationship to the end wall 32. A retaining guide shoulder 70 projects outward from the top of the guide wall 68 toward the end wall 32 to retain the actuator 56 to the base 12. With this configuration, the pilot portion 62 and therefore the actuator 56 has movement along an axis generally perpendicular to the center axis of the detector 10 over which the bracket 20 and base 12 mate. The lockout tab 64 projects through an elongate slot 72 in the face 27 of the base 12 for linear sliding movement therein. The slot 72 is conveniently formed over the guide shoulder 70 to facilitate easier molding of the detector base 12.

Figure 10:
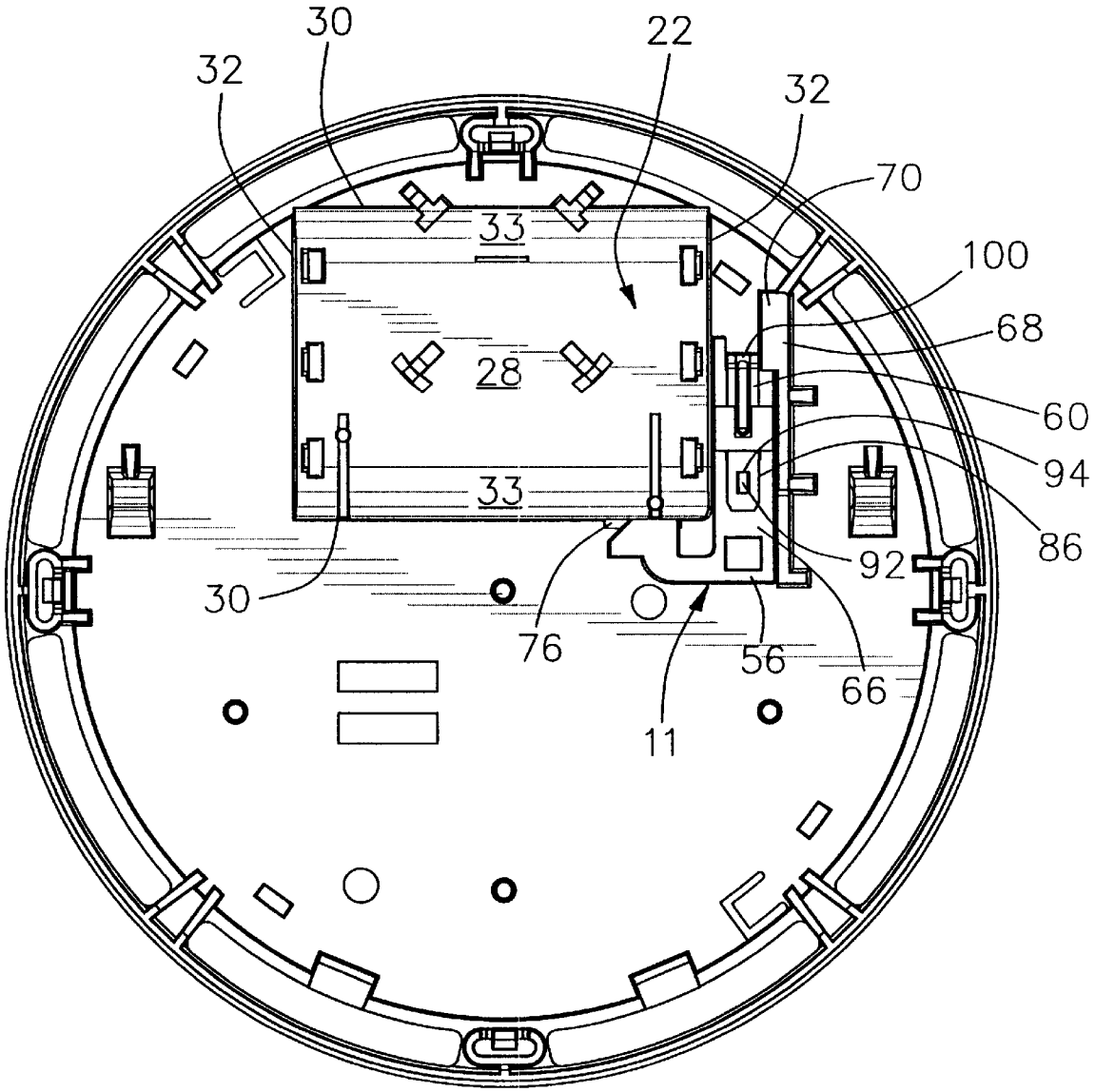
FIG. 10 is a bottom view of FIG. 9*b*.
Figure 11:
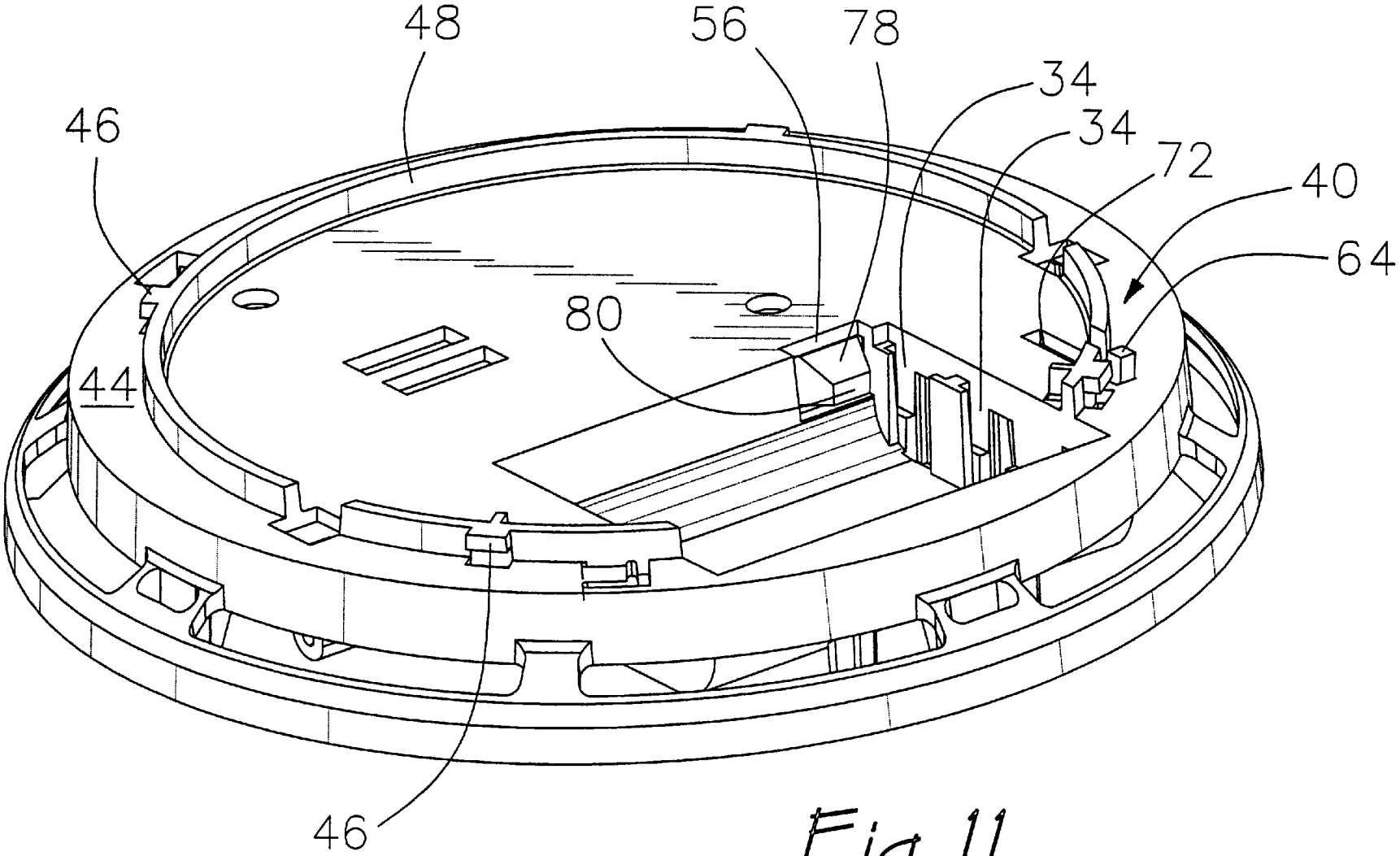
FIG. 11 is a perspective view of FIG. 9*a*.
Figure 16:
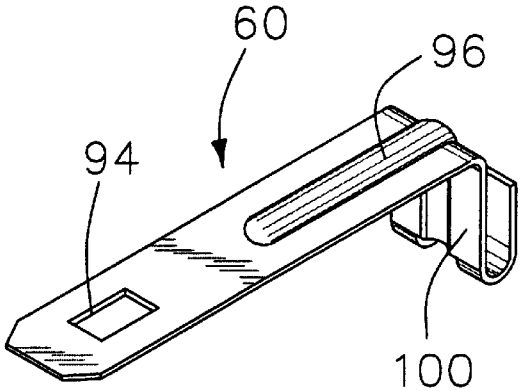
FIGS. 12–16 are side, bottom, top, end and perspective views of a retainer clip used in the preferred embodiment of the present invention.
Figure 14:
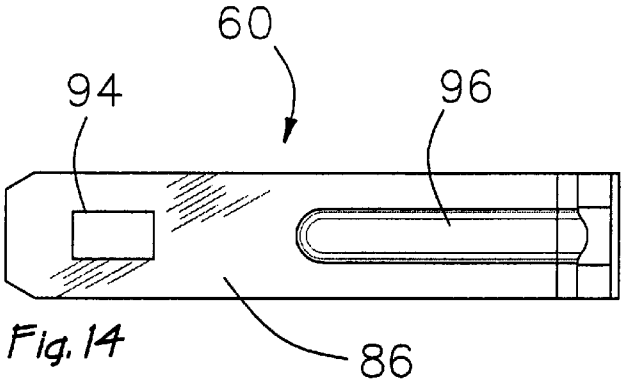
Figure 13:
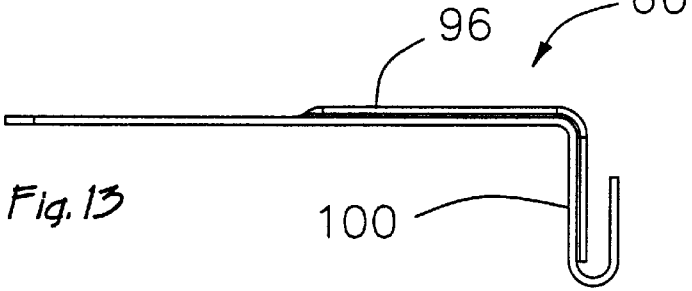
Figure 12:
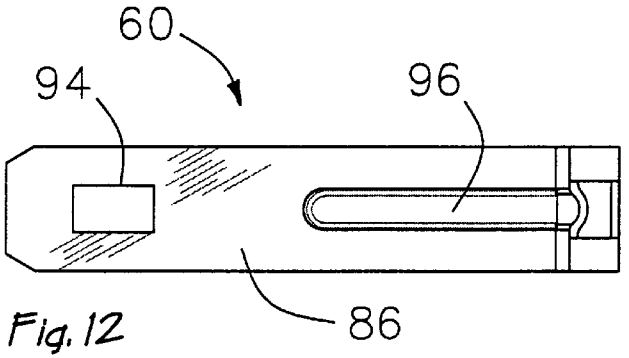
Figure 15:
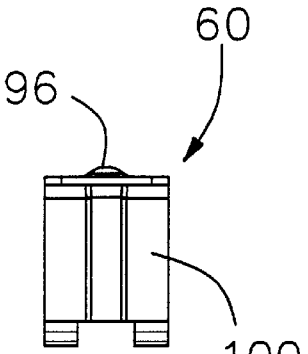
Figure 20:
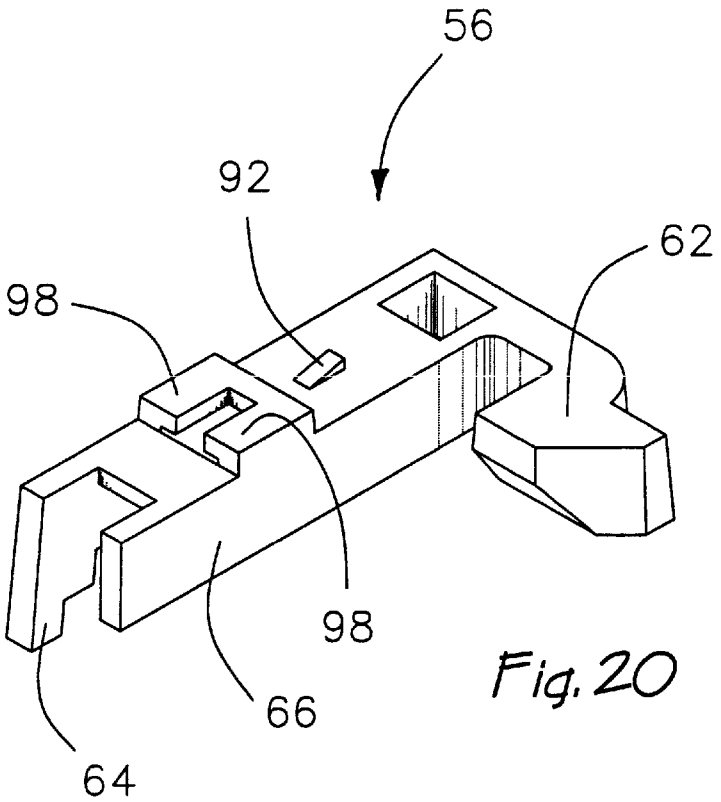
FIGS. 17–20 are top, end, side and perspective views of a lockout actuator used in the preferred embodiment of the present invention.
Figure 19:
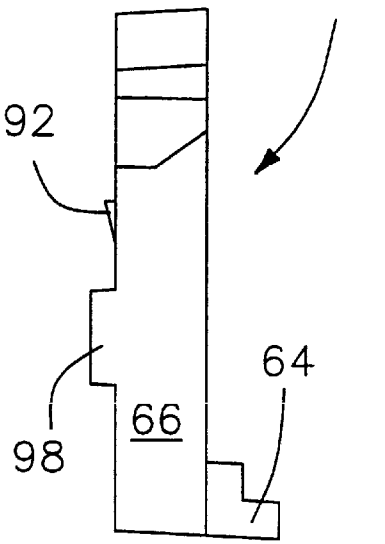
Figure 17:
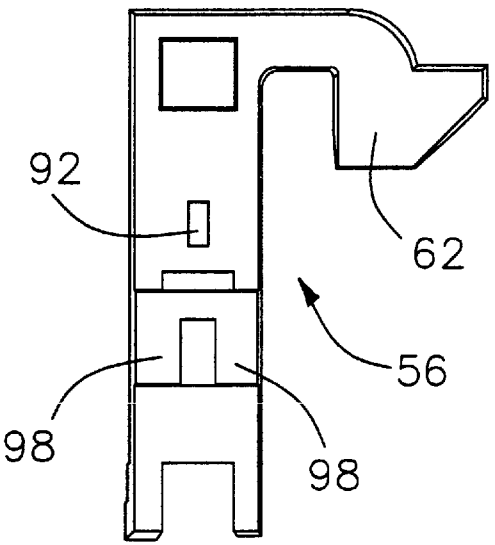
Figure 18:
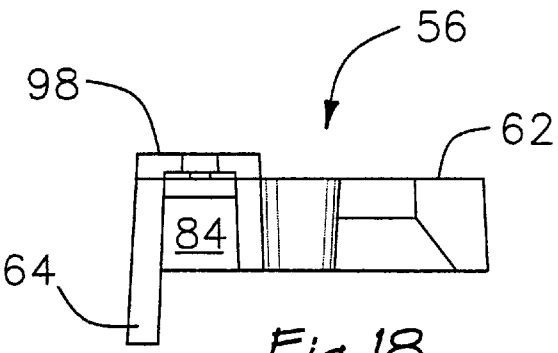
Figure 21:
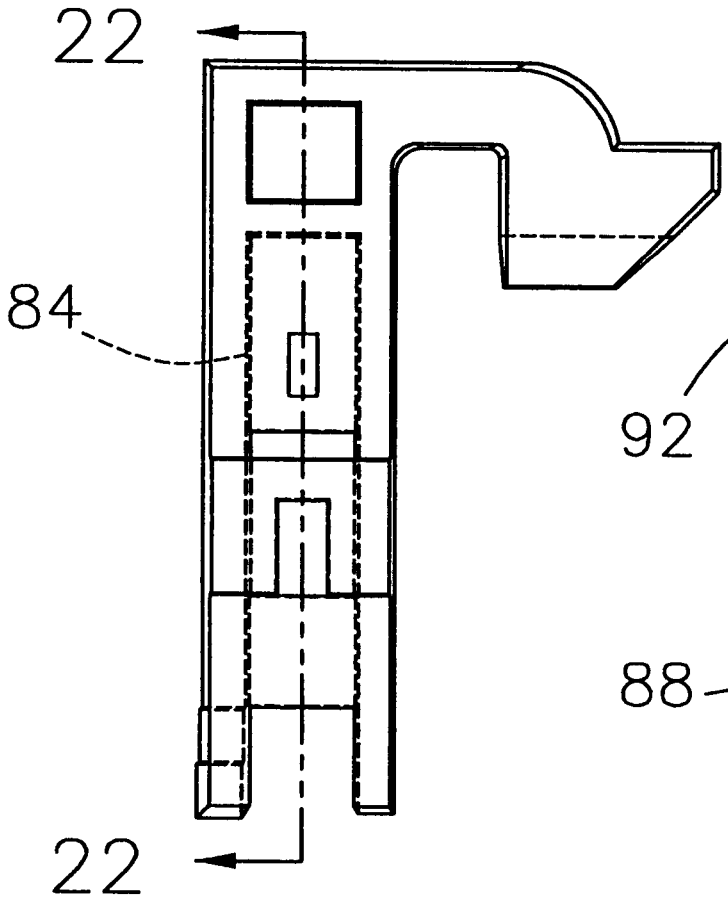
FIG. 21 is a top view of the lockout actuator illustrated in FIG. 17 with hidden lines illustrating various structural details of the lockout actuator.
Figure 22:
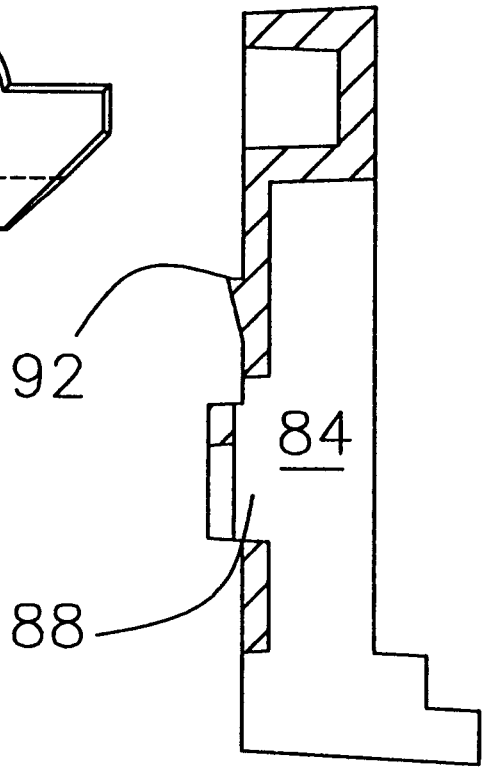
FIG. 22 is a cross-section of FIG. 21 taken about line 22—22.
Figure 23:
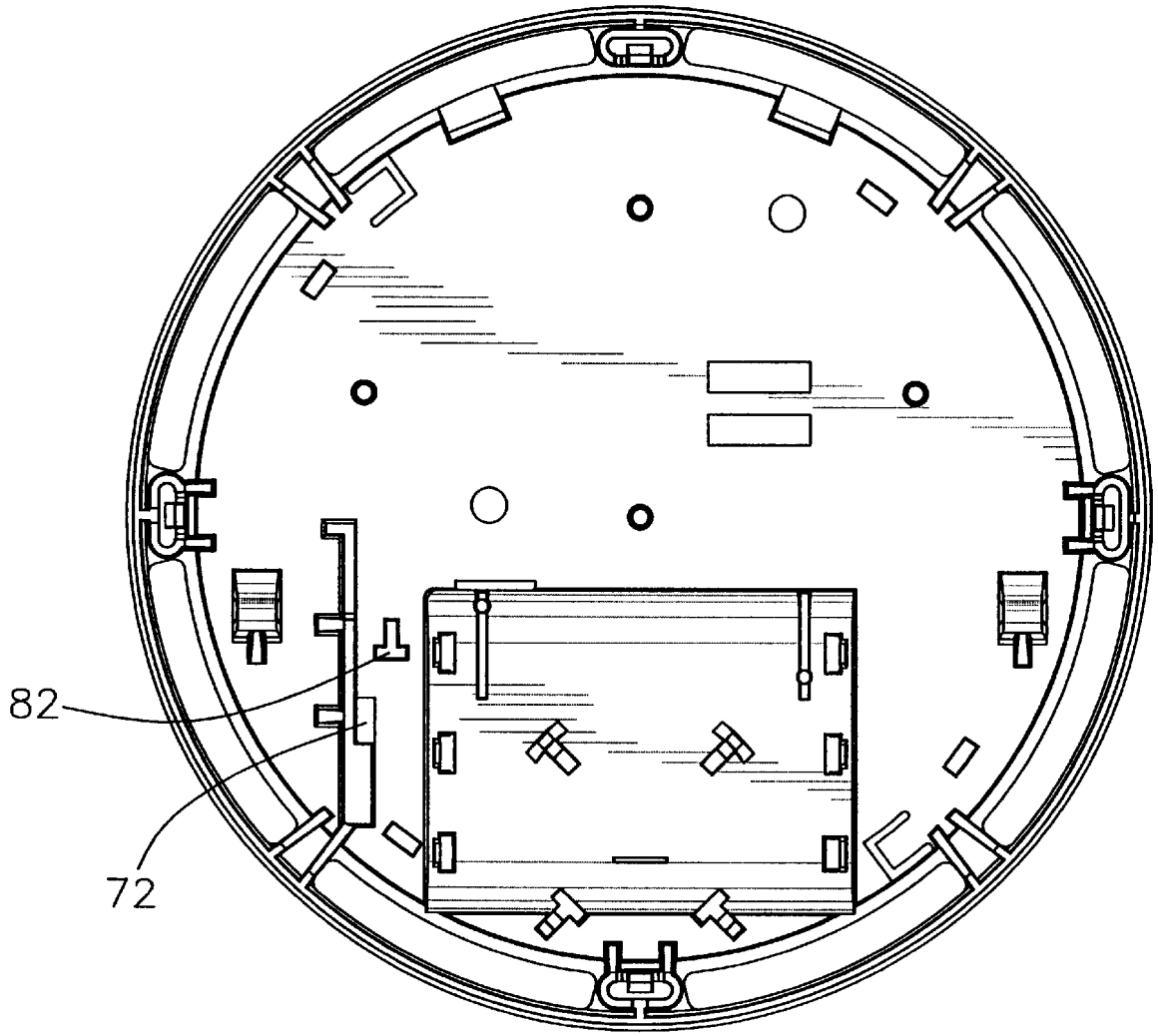
FIG. 23 is a bottom view of the detector base illustrated in FIG. 9*a*.
Figure 25:
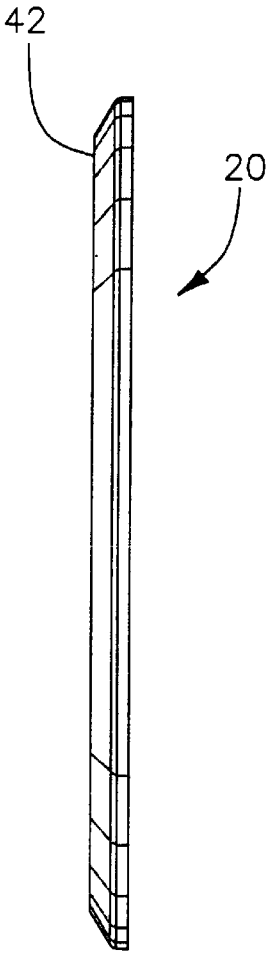
FIG. 25 is an end view of FIG. 24.

The spring 58 is supported by the base 12 and acts on the actuator 56 to bias it towards a home position. Without batteries in the compartment 26 (or fewer than all regions 23–25 being occupied by batteries) as illustrated in FIGS. 9A, 10 and 11, the spring 58 biases the actuator 56 towards an obstructing position in which the battery sensing portion 62 projects into the innermost end battery receiving region 23 through an opening 76 in the sidewall 30. In this position, the lockout tab 64 is located in the mating region 40 between the base 12 and the bracket 20. This prevents the retaining tabs 46 of the base 12 from being received into the slots 54 of the bracket 20 when rotation of the base 12 relative to the bracket 20 is attempted, thereby preventing the base 12 from mounting to the bracket 20. In particular, the tab 64 will engage the end surface 51 of a flange 50 when rotation is attempted.

When all of the batteries 26 are inserted into each of the battery receiving regions 23–25, the force of the spring 58 is overcome and the actuator 58 slides laterally towards a non-obstructing position. In the non-obstructing position, the lockout tab 64 is located adjacent the mating region 40 so as not to interfere with the rotation of the base 12 relative to the bracket 20 to ensure interlocking relationship between the retaining tabs 46 of the base 12 and the catch slots 54 of the bracket 20. In the preferred embodiment, the tab 64 retracts laterally such that it is disposed substantially flush with or behind the wall 48. To facilitate easy displacement of the actuator 56 when the last battery is inserted into the innermost region 23 of the compartment 22, the battery sensing portion 62 has an exposed beveled face 78 which transfers the vertical insertion force of the battery into lateral movement of the actuator 56. As such, the vertical position of lockout tab 64 relative to the base 12 is always the same but the lateral position of the lockout tab 64 depends upon whether the battery compartment is completely full of batteries 26.

It should be noted that the two battery terminals 36 of the innermost battery receiving region 23 are metallic and have some resiliency to ensure electrical contact between the battery and the terminals. As such, the force of the spring 58 is selected to overcome the resilient transverse force exerted by the terminals when a battery is received in the innermost region 23, but not all batteries are inserted. When only one battery is attempted to be inserted into the innermost region, the force of the spring 58 will exert sufficient force on the actuator 56 to displace the battery at least partially out of region 23 thereby maintaining the obstructing position or state. The flat nature of the bottom wall 28 easily allows for such displacement. However, when all batteries are inserted into the compartment 22, the rigid outermost side wall 30 provides support to the batteries 26 against the action of the spring 58 thereby preventing battery sliding and displacement. The battery sensing portion 62 also includes a battery contact face 80 parallel to the side walls 30 or otherwise contoured to the outer surface of the intended batteries to ensure that the lockout mechanism 11 does not vertically pop the batteries out of the compartment 22 when batteries are properly inserted therein.

The preferred embodiment also achieves the foregoing advantages while accomplishing a relatively inexpensive and easy assembly. To support one end of the spring 58, the base 12 integrally provides a support projection 82 which is received into a cavity 84 molded into the actuator 56. The cavity 84 also provides a spring chamber which houses the spring 58. To assembly the lockout mechanism 11, the actuator 56 is first inserted into the base 12 with tab 64 inserted through the slot 72 and then the pilot portion 66 is slid in along the guide wall 68. The cavity 84 allows the actuator 56 to be inserted over the support projection 82. The slot 72 is long enough and extends sufficiently inward to receive the tab 64 when the actuator 56 is first inserted. The spring 58 is then inserted into the cavity 84 to but up against the support projection 82. Lastly, the retaining clip 60 is secured to the actuator 56 to secure the spring inside the cavity 84. The clip 60 has a sliding strip portion 86 that slides through a slit 88 molded into the top portion of the actuator 56. The actuator 56 has a latch projection 92 onto which an opening 94 of the strip portion 86 snaps, thereby to secure the clip 60 to the actuator 56. Part of the strip portion 86 has formed therein an annular guide rail 96 which is received between two tracks 98 integrally formed into the actuator 56 which align the clip 60 to ensure the opening 94 aligns over the latch projection 92. The clip 60 also includes a retaining portion 100 extending generally perpendicular to the strip portion 86 to engage the spring 58 and transfer the spring force to the actuator 56. As the clip 60 is being moved into locking engagement with the actuator 56, the spring 58 is undergoing compression to provide the spring force necessary to provide the obstructing and non-obstructing positions when desired.

Figure 26:
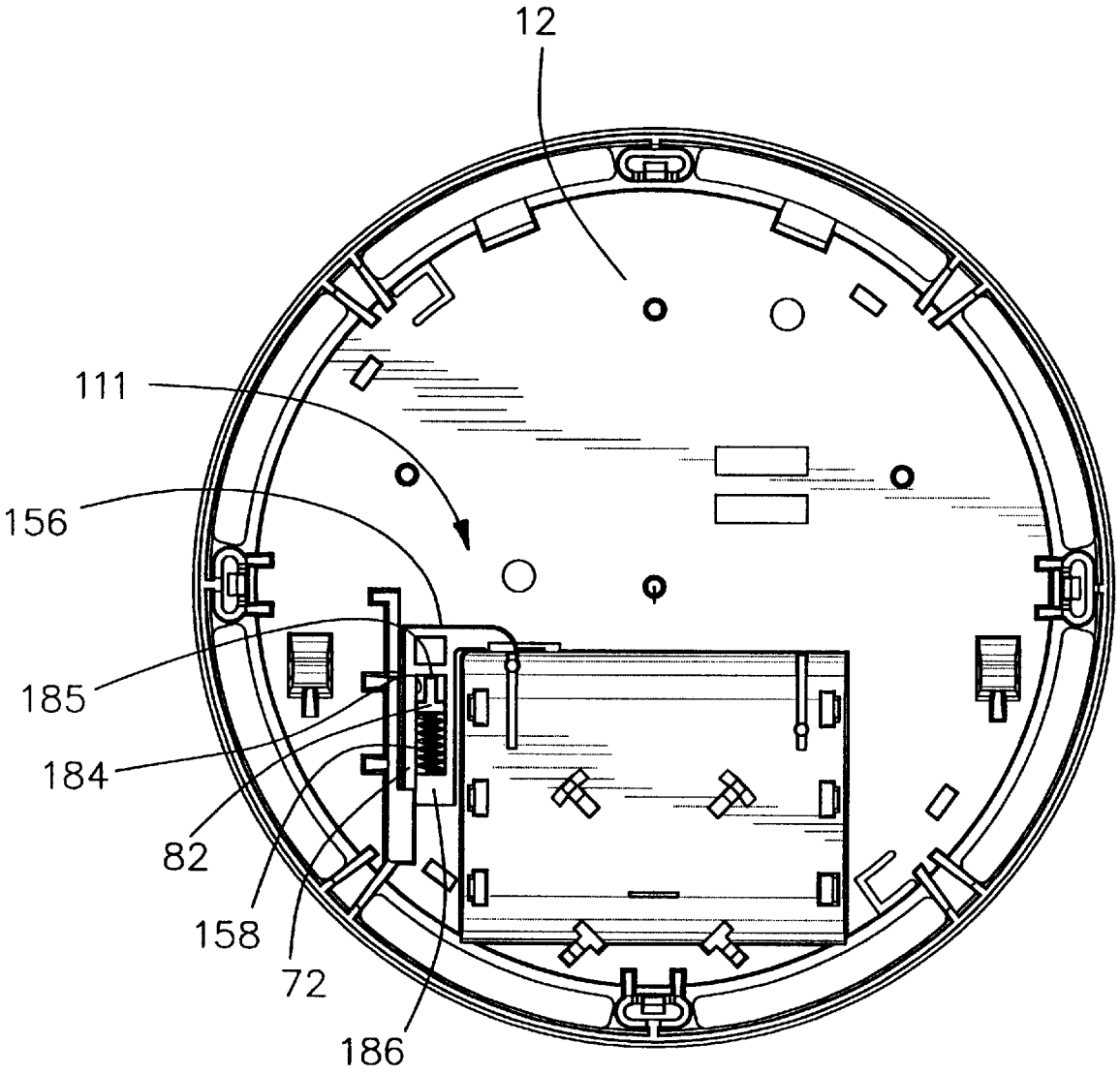
FIG. 26 is a detector base and lockout mechanism according to an alternative embodiment of the present invention.

Turning to FIG. 26, an alternative embodiment of the present invention is illustrated in which the lockout mechanism 111 comprises only a lockout actuator 156 and a spring 158, which is utilized with the same base 12 of the first embodiment. The lockout actuator 111 has an open spring chamber 184 enclosed by two end portions 185, 186 for insertion of the spring 158. The spring 158 acts on the actuator 156 by directly engaging the actuator 156.

All of the references cited herein, including patents, patent applications and publications are hereby incorporated in their entireties by reference. While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. An electrical detector unit adapted to be powered by multiple batteries, comprising:

a mounting bracket adapted to be secured to a surface;

a detector base adapted to mount to the mounting bracket over a mating region;

a cover connected to the detector base for enclosing electronic equipment between the base and the cover;

a multiple battery compartment in the detector base having a bottom wall, and side and end walls upright relative to the bottom wall, the side walls extending transversely between end walls;

an opening in one of the side walls;

a plurality of battery receiving regions disposed between side walls of the battery compartment;

a plurality of electrical terminals carried on the end walls, two terminals for each battery receiving region;

a lockout actuator movably mounted on the base for movement between obstructing and non-obstructing positions, having a battery sensing portion and a lockout tab, the battery sensing portion projecting through the opening into one of the battery receiving regions and the lockout tab projecting into the mating region while in the obstructing position to prevent mounting of the base to the bracket, the battery sensing portion disposed adjacent said one of the battery receiving regions and the tab disposed adjacent the mating region while in the non-obstructing position to allow the base to be mounted to the bracket; and a spring supported by the detector base biasing the lockout actuator towards the obstructing position.

2. The electrical detector unit of claim 1 wherein the force of the spring is sufficiently large to maintain the lockout actuator in the obstructing position when a battery is inserted said one of the battery receiving regions but less than all battery receiving regions are occupied by batteries, one of the side walls adapted to support the batteries against the lockout actuator to maintain the lockout actuator in the non-obstructing position when all batteries are inserted in the compartment.

3. The electrical detector unit of claim 1 wherein the bracket has a generally radially planar seating surface and a plurality of retaining members spaced about the seating surface, the base has a mating surface and a plurality of catch members spaced about the mating surface, the base mounting to the bracket with the mating surface of the base seating against the seating surface of the bracket and the base being rotated relative to the bracket to cause interlocking engagement between the catch and retaining members, the tab contacting one of the retaining members during rotation of the base and while in the obstructing position to prevent the interlocking engagement between the catch and retaining members.

4. The electrical detector unit of claim 3 wherein the retaining members project outward from a cylindrical wall integral with the base, the catches comprise slots formed beneath the seating surface.

5. The electrical detector unit of claim 4 wherein the tab projects between the retaining members and slots when in the obstructing position.

6. The electrical detector unit of claim 1 wherein the base is adapted to mount to the bracket over a first axis, the lockout actuator and lockout tab sliding along a second axis perpendicular to said first axis.

7. The electrical detector unit of claim 1 wherein the detector base includes a guide wall parallel to one of the end walls, the top of the guide wall including a guide shoulder projecting towards said one of the end walls, and a spring support between the end walls engaging an end of the spring, the lockout actuator including pilot portion slidably inserted between guide wall and said one of the end walls and retained therein by the guide shoulder, the pilot portion including a cavity housing the spring.

8. The electrical detector unit of claim 7 further comprising a retaining clip affixed to the lockout actuator and engaging the other end of the spring.

9. The electrical detector unit of claim 6 wherein the battery sensing portion has an exposed beveled surface adapted to engage a battery and displace the lockout actuator to the non-obstructing position.

10. The electrical detector unit of claim 1 wherein said plurality of battery receiving regions includes three battery receiving regions aligned in a common plane.

11. An electrical detector unit adapted to be powered by multiple batteries, comprising:

a mounting bracket adapted to be secured to a surface;

a detector base adapted to mount to the mounting bracket, the detector base;

a multiple battery compartment in the detector base including a plurality of battery receiving regions adapted to receive the multiple batteries;

a single lockout actuator for all of the battery receiving regions having a battery sensing portion projecting into the battery compartment, the actuator movably mounted on the base for movement between obstructing and non-obstructing positions, the lockout actuator preventing the base from mounting to the bracket in the obstructing position and allowing the base to mount to the bracket in the non-obstructing position; and a spring supported by the detector base biasing the lockout actuator towards the obstructing position, maintaining the lockout actuator in the obstructing position when fewer than all battery receiving regions are occupied by batteries, the action of the spring being overcome when all of the battery receiving regions are occupied by batteries, thereby displacing the lockout actuator to the non-obstructing position.

12. The electrical detector unit of claim 11 wherein the base mounts to the bracket over a mating region, and wherein the lockout actuator includes a lockout tab, the lockout tab projecting into the mating region in the obstructing position to prevent mounting of the base to the bracket, the battery sensing portion disposed adjacent said one of the battery receiving regions and the tab disposed adjacent the mating region in the non-obstructing position to allow the base to be mounted to the bracket.

13. The electrical detector unit of claim 12 wherein the multiple battery compartment in the detector base integrally provides a bottom wall, and side and end walls upright relative to the bottom wall, the side walls extending transversely between end walls, the battery sensing portion projecting through one of the side walls and into one of the battery receiving regions.

14. The electrical detector unit of claim 12 wherein the force of the spring is sufficiently large to maintain the lockout actuator in the obstructing position when a battery is inserted said one of the battery receiving regions but less than all battery receiving regions are occupied by batteries.

15. The electrical detector unit of claim 12 wherein the base is adapted to mount to the bracket over a first axis, the lockout actuator and lockout tab sliding along a second axis perpendicular to said first axis.

16. An electrical unit adapted to be powered by multiple batteries, comprising:

a housing for supporting an electrical component;

a multiple battery compartment in the housing having a bottom wall, and side and end walls upright relative to the bottom wall, the side walls extending transversely between end walls;

a plurality of battery receiving regions disposed between side walls;

a plurality of electrical terminals carried on the end walls, two terminals for each battery receiving region;

means connectable to the housing for retaining multiple batteries in the battery compartment;

a single lockout actuator for the battery receiving regions mounted on the housing for movement between obstructing and non-obstructing positions, having a battery sensing portion and a lockout tab, the battery sensing portion projecting into one of the battery receiving regions and the lockout tab projecting between the housing and the retaining means in the obstructing position to prevent connection of the housing and the retaining means, the battery sensing portion disposed adjacent said one of the battery receiving regions and the tab being displaced to the non-obstructing position to allow the base to be mounted to the bracket; and a spring supported by the housing biasing the lockout actuator towards the obstructing position.

17. The electrical unit of claim 16 wherein the force of the spring is sufficiently large to maintain the lockout actuator in the obstructing position when a battery is inserted said one of the battery receiving regions but less than all battery receiving regions are occupied by batteries.

18. The electrical unit of claim 17 wherein one of the side walls adapted to support the batteries against the lockout actuator to maintain the lockout actuator in the non-obstructing position.

19. The electrical unit of claim 18 wherein the other one of the side walls includes an opening, the battery sensing portion projecting through said opening.

20. The electrical unit of claim 16 wherein the retaining means is a mounting bracket adapted to be secured to a surface and the housing is a base adapted to mount to the mounting bracket.

* * * * *

UNITED STATES PATENT AND TRADEMARK OFFICE

CERTIFICATE OF CORRECTION

PATENT NO. : 6,160,487

DATED : December 12, 2000

INVENTOR(S) : Joseph G. DeLuca

It is certified that error appears in the above-identified patent and that said Letters Patent is hereby corrected as shown below:

On the title page: Item [73]

Please add the name and address of the Assignee:

Walter Kidde Portable Equipment, Inc.
4980 Centennial Blvd.
Colorado Springs, Colorado 80904

Signed and Sealed this

Eighth Day of May, 2001

*Attest:*

Nicholas P. Godici

NICHOLAS P. GODICI

*Attesting Officer*

*Acting Director of the United States Patent and Trademark Office*